US009650871B2

(12) United States Patent
Oehring et al.

(10) Patent No.: US 9,650,871 B2
(45) Date of Patent: May 16, 2017

(54) SAFETY INDICATOR LIGHTS FOR HYDRAULIC FRACTURING PUMPS

(71) Applicant: US Well Services LLC, Houston, TX (US)

(72) Inventors: Jared Oehring, Houston, TX (US); Brandon Neil Hinderliter, Buckhannon, WV (US)

(73) Assignee: US Well Services LLC, Houston, TX (US)

( * ) Notice: Subject to any disclaimer, the term of this patent is extended or adjusted under 35 U.S.C. 154(b) by 0 days.

(21) Appl. No.: 15/217,040

(22) Filed: Jul. 22, 2016

(65) Prior Publication Data

US 2017/0022788 A1 Jan. 26, 2017

Related U.S. Application Data

(60) Provisional application No. 62/196,350, filed on Jul. 24, 2015.

(51) Int. Cl.
*E21B 43/26* (2006.01)
*E21B 41/00* (2006.01)
(Continued)

(52) U.S. Cl.
CPC ..... *E21B 41/0021* (2013.01); *E21B 43/26* (2013.01); *F04B 17/03* (2013.01); *F04B 19/22* (2013.01); *F04B 23/06* (2013.01); *F04B 47/00* (2013.01); *F04B 47/02* (2013.01); *F04B 49/065* (2013.01); *F04B 49/08* (2013.01); *F04B 49/103* (2013.01); *F04B 49/20* (2013.01); *F04B 51/00* (2013.01); *G08B 5/36* (2013.01); *F04B 2205/05* (2013.01)

(58) Field of Classification Search
CPC ..... E21B 43/26
See application file for complete search history.

(56) References Cited

U.S. PATENT DOCUMENTS 1,671,436 A 5/1928 Melott
2,004,077 A 6/1935 McCartney
(Continued)

FOREIGN PATENT DOCUMENTS

JP 2004264589 9/2004

OTHER PUBLICATIONS

UK Power Networks—Transformers to Supply Heat to Tate Modern—from Press Releases May 16, 2013.
(Continued)

*Primary Examiner* — Kenneth L Thompson
(74) *Attorney, Agent, or Firm* — Hogan Lovells US LLP

(57) ABSTRACT

A hydraulic fracturing system includes an electrically powered pump that pressurizes fluid, which is piped into a wellbore to fracture a subterranean formation. System components include a fluid source, an additive source, a hydration unit, a blending unit, a proppant source, a fracturing pump, and an electrically powered motor for driving the pump. Also included with the system is a signal assembly that visually displays operational states of the pump and motor, thereby indicating if fluid discharge lines from the pump contain pressurized fluid. The visual display of the signal assembly also can indicate if the motor is energized, so that the discharge lines might soon contain pressurized fluid.

19 Claims, 4 Drawing Sheets

(51) Int. Cl.

| | |
|---|---|
| ***F04B 49/20*** | (2006.01) |
| ***F04B 49/10*** | (2006.01) |
| ***F04B 17/03*** | (2006.01) |
| ***F04B 19/22*** | (2006.01) |
| ***F04B 23/06*** | (2006.01) |
| ***F04B 47/00*** | (2006.01) |
| ***G08B 5/36*** | (2006.01) |
| ***F04B 47/02*** | (2006.01) |
| ***F04B 49/06*** | (2006.01) |
| ***F04B 49/08*** | (2006.01) |
| ***F04B 51/00*** | (2006.01) |

(56) References Cited

U.S. PATENT DOCUMENTS 2,220,622 A 11/1940 Aitken
2,248,051 A 7/1941 Armstrong
3,061,039 A 10/1962 Peters
3,066,503 A 12/1962 Fleming
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,881,551 A 5/1975 Terry
4,037,431 A 7/1977 Sugimoto
4,151,575 A 4/1979 Hogue
4,226,299 A 10/1980 Hansen
4,456,092 A 6/1984 Kubozuka
4,506,982 A 3/1985 Smithers et al.
4,512,387 A 4/1985 Rodriguez
4,538,916 A 9/1985 Zimmerman
4,793,386 A 12/1988 Sloan
4,845,981 A 7/1989 Pearson
4,922,463 A 5/1990 Del Zotto et al.
5,025,861 A 6/1991 Huber et al.
5,130,628 A 7/1992 Owen
5,131,472 A 7/1992 Dees et al.
5,422,550 A 6/1995 McClanahan
5,548,093 A 8/1996 Sato
5,590,976 A 1/1997 Kilheffer et al.
5,655,361 A 8/1997 Kishi
5,865,247 A * 2/1999 Paterson ..... E21B 33/138 166/252.1
5,879,137 A 3/1999 Yie
5,894,888 A 4/1999 Wiemers
5,907,970 A 6/1999 Havlovick et al.
6,142,878 A 11/2000 Barin
6,164,910 A 12/2000 Mayleben
6,202,702 B1 3/2001 Ohira
6,254,462 B1 7/2001 Kelton
6,271,637 B1 8/2001 Kushion
6,315,523 B1 11/2001 Mills
6,491,098 B1 12/2002 Dallas
6,529,135 B1 3/2003 Bowers et al.
6,776,227 B2 8/2004 Beida
6,802,690 B2 10/2004 Han
6,808,303 B2 10/2004 Fisher
6,931,310 B2 8/2005 Shimizu et al.
7,170,262 B2 1/2007 Pettigrew
7,173,399 B2 2/2007 Sihler
7,312,593 B1 12/2007 Streicher et al.
7,336,514 B2 2/2008 Amarillas
7,445,041 B2 11/2008 O'Brien
7,500,642 B2 3/2009 Cunningham
7,525,264 B2 4/2009 Dodge
7,563,076 B2 7/2009 Brunet
7,683,499 B2 3/2010 Saucier
7,755,310 B2 7/2010 West et al.
7,807,048 B2 10/2010 Collette
7,845,413 B2 12/2010 Shampine et al.
8,037,936 B2 10/2011 Neuroth
8,054,084 B2 11/2011 Schulz et al.
8,083,504 B2 12/2011 Williams
8,096,891 B2 1/2012 Lochtefeld
8,146,665 B2 4/2012 Neal
8,272,439 B2 9/2012 Strickland
8,310,272 B2 11/2012 Quarto
8,354,817 B2 1/2013 Yeh et al.
8,474,521 B2 7/2013 Kajaria
8,534,235 B2 9/2013 Chandler
8,573,303 B2 11/2013 Kerfoot
8,596,056 B2 12/2013 Woodmansee
8,727,068 B2 5/2014 Bruin
8,760,657 B2 6/2014 Pope
8,774,972 B2 7/2014 Rusnak et al.
8,789,601 B2 * 7/2014 Broussard ..... E21B 43/26 166/177.5
8,807,960 B2 * 8/2014 Stephenson ..... F04B 23/06 166/105
8,838,341 B2 9/2014 Kumano
8,857,506 B2 10/2014 Stone, Jr.
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,067,182 B2 6/2015 Nichols
9,103,193 B2 8/2015 Coli
9,140,110 B2 9/2015 Coli et al.
9,160,168 B2 10/2015 Chapel
9,322,239 B2 4/2016 Angeles Boza et al.
9,366,114 B2 6/2016 Coli et al.
9,410,410 B2 * 8/2016 Broussard ..... E21B 43/26
9,587,649 B2 3/2017 Oehring
2003/0138327 A1 7/2003 Jones et al.
2007/0187163 A1 8/2007 Cone
2007/0201305 A1 8/2007 Heilman et al.
2007/0226089 A1 9/2007 DeGaray et al.
2007/0278140 A1 12/2007 Mallett et al.
2008/0112802 A1 5/2008 Orlando
2008/0137266 A1 * 6/2008 Jensen ..... H02B 1/21 361/602
2008/0217024 A1 9/2008 Moore
2008/0264649 A1 10/2008 Crawford
2009/0065299 A1 3/2009 Vito
2009/0153354 A1 6/2009 Daussin et al.
2009/0188181 A1 7/2009 Forbis
2009/0260826 A1 * 10/2009 Sherwood ..... E21B 41/0057 166/305.1
2009/0308602 A1 12/2009 Bruins et al.
2010/0000508 A1 1/2010 Chandler
2010/0132949 A1 6/2010 DeFosse et al.
2010/0250139 A1 9/2010 Hobbs et al.
2010/0303655 A1 12/2010 Scekic
2010/0322802 A1 12/2010 Kugelev
2011/0005757 A1 1/2011 Hebert
2011/0017468 A1 1/2011 Birch et al.
2011/0085924 A1 4/2011 Shampine
2011/0272158 A1 11/2011 Neal
2012/0018016 A1 1/2012 Gibson
2012/0085541 A1 4/2012 Love et al.
2012/0127635 A1 5/2012 Grindeland
2012/0205301 A1 8/2012 McGuire et al.
2012/0205400 A1 8/2012 DeGaray et al.
2012/0255734 A1 * 10/2012 Coli ..... E21B 43/26 166/305.1
2013/0025706 A1 1/2013 DeGaray et al.
2013/0199617 A1 8/2013 DeGaray et al.
2013/0233542 A1 9/2013 Shampine
2013/0306322 A1 * 11/2013 Sanborn ..... E21B 43/26 166/308.1
2013/0341029 A1 12/2013 Roberts et al.
2014/0000899 A1 1/2014 Nevison
2014/0010671 A1 * 1/2014 Cryer ..... B60W 10/30 417/53
2014/0096974 A1 * 4/2014 Coli ..... E21B 43/26 166/358
2014/0124162 A1 5/2014 Leavitt
2014/0251623 A1 9/2014 Lestz et al.
2015/0083426 A1 3/2015 Lesko

(56) References Cited

U.S. PATENT DOCUMENTS

| | | | | |
|---|---|---|---|---|
| 2015/0114652 | A1* | 4/2015 | Lestz | E21B 43/26 166/308.1 |
| 2015/0159911 | A1 | 6/2015 | Holt | |
| 2015/0175013 | A1 | 6/2015 | Cryer et al. | |
| 2015/0176386 | A1 | 6/2015 | Castillo et al. | |
| 2015/0211524 | A1* | 7/2015 | Broussard | F04D 29/044 417/423.1 |
| 2015/0225113 | A1 | 8/2015 | Lungu | |
| 2015/0252661 | A1 | 9/2015 | Glass | |
| 2016/0032703 | A1* | 2/2016 | Broussard | E21B 43/267 166/250.01 |
| 2016/0105022 | A1 | 4/2016 | Oehring | |
| 2016/0177678 | A1 | 6/2016 | Morris | |
| 2016/0208592 | A1 | 7/2016 | Oehring | |
| 2016/0221220 | A1 | 8/2016 | Paige | |
| 2016/0258267 | A1 | 9/2016 | Payne et al. | |
| 2016/0273328 | A1 | 9/2016 | Oehring | |
| 2016/0290114 | A1 | 10/2016 | Oehring | |
| 2016/0319650 | A1 | 11/2016 | Oehring | |
| 2016/0326854 | A1 | 11/2016 | Broussard | |
| 2016/0348479 | A1 | 12/2016 | Oehring | |
| 2016/0349728 | A1 | 12/2016 | Oehring | |
| 2017/0022788 | A1 | 1/2017 | Oehring et al. | |
| 2017/0028368 | A1 | 2/2017 | Oehring et al. | |
| 2017/0030177 | A1 | 2/2017 | Oehring et al. | |
| 2017/0030178 | A1 | 2/2017 | Oehring et al. | |

OTHER PUBLICATIONS

Non-Final Office Action issued in corresponding U.S. Appl. No. 15/291,842 dated Jan. 6, 2017.

Non-Final Office Action issued in corresponding U.S. Appl. No. 15/293,681 dated Feb. 16, 2017.

Non-Final Office Action issued in corresponding U.S. Appl. No. 15/294,349 dated Mar. 14, 2017.

Final Office Action issued in corresponding U.S. Appl. No. 15/145,491 dated Jan. 20, 2017.

Non-Final Office Action issued in corresponding U.S. Appl. No. 15/145,443 dated Feb. 7, 2017.

Notice of Allowance issued in corresponding U.S. Appl. No. 14/622,532 dated Mar. 27, 2017.

* cited by examiner

SAFETY INDICATOR LIGHTS FOR HYDRAULIC FRACTURING PUMPS

CROSS REFERENCE TO RELATED APPLICATIONS

This application claims priority to and the benefit of, U.S. Provisional Application Ser. No. 62/196,350, filed Jul. 24, 2015 and is a continuation-in-part of, and claims priority to and the benefit of co-pending U.S. patent application Ser. No. 13/679,689, filed Nov. 16, 2012, the full disclosures of which are hereby incorporated by reference herein for all purposes.

BACKGROUND OF THE INVENTION

1. Field of Invention

The present disclosure relates to hydraulic fracturing of subterranean formations. In particular, the present disclosure relates to an electrical hydraulic fracturing system having different colored lights that are selectively illuminated to indicate an operational state of the fracturing system.

2. Description of Prior Art

Hydraulic fracturing is a technique used to stimulate production from some hydrocarbon producing wells. The technique usually involves injecting fluid into a wellbore at a pressure sufficient to generate fissures in the formation surrounding the wellbore. Typically the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. A primary fluid for the slurry other than water, such as nitrogen, carbon dioxide, foam (nitrogen and water), diesel, or other fluids is sometimes used as the primary component instead of water. Typically hydraulic fracturing fleets include a data van unit, blender unit, hydration unit, chemical additive unit, hydraulic fracturing pump unit, sand equipment, and other equipment.

Traditionally, the fracturing fluid slurry has been pressurized on surface by high pressure pumps powered by diesel engines. To produce the pressures required for hydraulic fracturing, the pumps and associated engines have substantial volume and mass. Heavy duty trailers, skids, or trucks are required for transporting the large and heavy pumps and engines to sites where wellbores are being fractured. Each hydraulic fracturing pump is usually composed of a power end and a fluid end. The hydraulic fracturing pump also generally contains seats, valves, a spring, and keepers internally. These parts allow the hydraulic fracturing pump to draw in low pressure fluid slurry (approximately 100 psi) and discharge the same fluid slurry at high pressures (over 10,000 psi). Recently electrical motors controlled by variable frequency drives have been introduced to replace the diesel engines and transmission, which greatly reduces the noise, emissions, and vibrations generated by the equipment during operation, as well as its size footprint.

On each separate unit, a closed circuit hydraulic fluid system is often used for operating auxiliary portions of each type of equipment. These auxiliary components may include dry or liquid chemical pumps, augers, cooling fans, fluid pumps, valves, actuators, greasers, mechanical lubrication, mechanical cooling, mixing paddles, landing gear, and other needed or desired components. This hydraulic fluid system is typically separate and independent of the main hydraulic fracturing fluid slurry that is being pumped into the wellbore. The lines carrying the pressurized fluid from the pumps, often referred to as discharge iron, can fail without warning. Metal shrapnel or the high pressure fluid slurry from the failed discharge iron can cause personal injury to any personnel proximate the failure. While the best way to avoid personal injury is for operations personal to avoid zones proximate the discharge iron, maintenance or inspection requires entry into these zones.

SUMMARY OF THE INVENTION

Disclosed herein is an example of a hydraulic fracturing system for fracturing a subterranean formation, and which includes a plurality of electric pumps fluidly connected to the formation, and powered by at least one electric motor, and configured to pump fluid at high pressure into a wellbore that intersects the formation, so that the fluid passes from the wellbore into the formation, and fractures the formation, a variable frequency drive connected to the electric motor to control the speed of the motor, wherein the variable frequency drive frequently performs electric motor diagnostics to prevent damage to the at least one electric motor, and a signal assembly that selectively emits a visual signal that is indicative of an operational state of the hydraulic fracturing system. In an example, the signal assembly includes a plurality of light assemblies arranged in a stack. In this example, each of the light assemblies selectively emit visual light of a color different from visual light emitted by other light assemblies. Further in this example, a distinctive operational state of the system is indicated by illumination of a combination of the light assemblies. Example operational states of the hydraulic fracturing system include, no electricity to the system, a supply of electricity to all electrically powered devices in the system, a supply of electricity to some of the electrically powered devices in the system, and a pressure in a discharge line of the pump having a magnitude that is at least that of a designated pressure. A controller can be included that is in communication with the variable frequency drive, a pressure indicator that senses pressure in a discharge line of a one of the pumps, and the signal assembly. In this example, the controller selectively activates the signal assembly in response to a communication signal from one of the variable frequency drive or the pressure indicator, or directly from a command signal from an operator controlled computer. Optionally the visual signal is made up of light in the visible spectrum, and that is optically detectable by operations personnel disposed in a zone that is potentially hazardous due to fluid in piping that is pressurized by at least one of the pumps.

Also described herein is an example of a hydraulic fracturing system for fracturing a subterranean formation and which includes a pump having a discharge in communication with a wellbore that intersects the formation, an electric motor coupled to and that drives the pump, a variable frequency drive connected to the electric motor that controls a speed of the motor and performs electric motor diagnostics, a signal assembly that selectively emits different visual signals that are distinctive of an operational state of the system, and a controller in communication with the signal assembly, and that selectively transmits a command signal to the signal assembly in response to a monitoring signal received by the controller and transmitted from a device in the system. Examples exist wherein the device in the system that transmits the monitoring signal to the controller can be a variable frequency drive or a pressure monitor in fluid communication with the discharge of the pump. The signal assembly can be a stack of light assemblies. In one embodiment, light assemblies each are made up of an electrically powered light source, and that each emit light of a color that is different from a color of a light emitted by the other light assemblies. In an alternative, further included with the system is a pump controller and auxiliary equipment, and wherein the operational state of the system can be, the system being isolated from electricity, a fluid pressure of the discharge having a value at least as great as a designated value, the pump controller being energized, and the auxiliary equipment being energized but without a one of the motors being energized. The visual signals can selectively indicate when the system is safe for operations personnel, when the system is potentially unsafe for operations personnel, and when the system is currently unsafe for operations personnel.

An example of a method of fracturing a subterranean formation is also described herein and which includes pressurizing fracturing fluid with a pump, driving the pump with a motor that is powered by electricity, monitoring an operational state of a hydraulic fracturing system that comprises the pump and motor, and selectively emitting a visual signal that is indicative of the monitored operational state. The operational state of the system includes isolation from electricity, a fluid pressure of the discharge of the pump having a value at least as great as a designated value, the pump controller being energized, and the auxiliary equipment being energized but without a one of the motors being energized. Selectively emitting a visual signal can be emitting a light from one or more of a stack of light assemblies, where light from one of the stack of light assemblies is different from lights emitted from other light assemblies. The method can further include monitoring electricity to a variable frequency drive, wherein the variable frequency drive controls electricity to the motor. The method can optionally include monitoring a fluid pressure of the discharge of the pump.

BRIEF DESCRIPTION OF DRAWINGS

Some of the features and benefits of the present invention having been stated, others will become apparent as the description proceeds when taken in conjunction with the accompanying drawings, in which.

Figure 1:
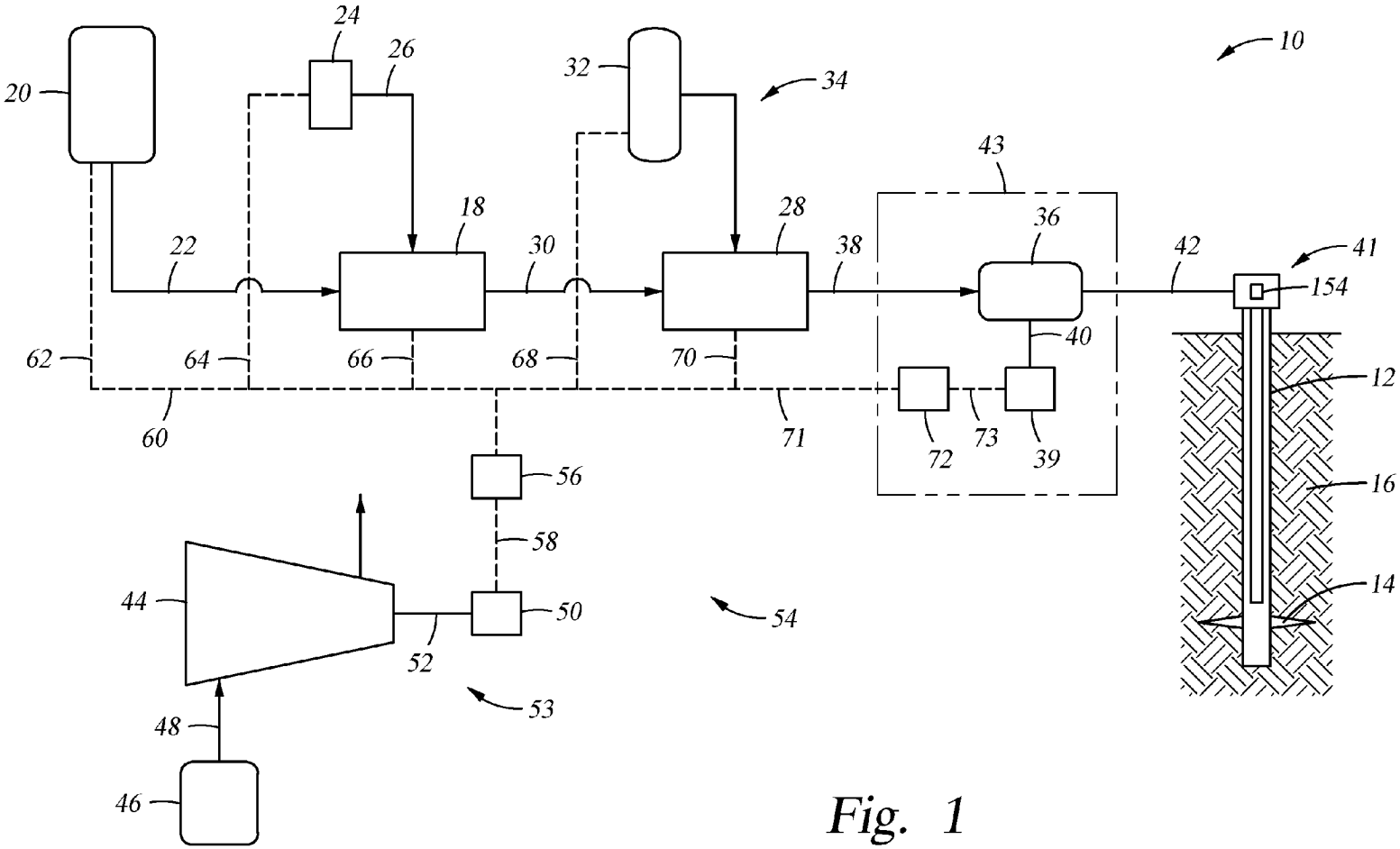
FIG. 1 is a schematic of an example of a hydraulic fracturing system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid. In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump assembly 36 via line 38; thus fluid in line 38 includes the discharge of blender unit 28, which is the suction (or boost) for the fracturing pump assembly 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by fracturing pump assembly 36. A motor 39, which connects to fracturing pump assembly 36 via connection 40, drives fracturing pump assembly 36 so that it can pressurize the slurry. After being discharged from fracturing pump assembly 36, slurry is injected into a wellhead assembly 41; discharge piping 42 connects discharge of fracturing pump assembly 36 with wellhead assembly 41 and provides a conduit for the slurry between the fracturing pump assembly 36 and the wellhead assembly 41. The fracturing pump assembly 36, motor 39, connection 40, lines 38, piping 42, VFD 72, and line 73 define one example of a fracturing pump system 43. In an alternative, hoses or other connections can be used to provide a conduit for the slurry between the pump assembly 36 and the wellhead assembly 41. Optionally, any type of fluid can be pressurized by the fracturing pump assembly 36 to form injection fracturing fluid that is then pumped into the wellbore 12 for fracturing the formation 14, and is not limited to fluids having chemicals or proppant. Examples exist wherein the system 10 includes multiple fracturing pump assemblies 36, and multiple motors 39 for driving the multiple fracturing pump assemblies 36. Examples also exist wherein the system 10 includes the ability to pump down equipment, instrumentation, or other retrievable items through the slurry into the wellbore.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50. An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other stepped down voltages can include 4,160 V, 480 V, or other voltages. The output or low voltage side of the transformer 56 connects to a power bus 60, lines 62, 64, 66, 68, 70, and 71 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60, and line 71 connects bus 60 to an optional variable frequency drive ("VFD") 72. Line 73 connects VFD 72 to motor 39. In one example, VFD 72 selectively provides electrical power to motor 39 via line 73, and can be used to control operation of motor 39, and thus also operation of pump 36.

In an example, additive source 24 contains ten or more chemical pumps for supplementing the existing chemical pumps on the hydration unit 18 and blender unit 28. Chemicals from the additive source 24 can be delivered via lines 26 to either the hydration unit 18 and/or the blender unit 28. In one embodiment, the elements of the system 10 are mobile and can be readily transported to a wellsite adjacent the wellbore 12, such as on trailers or other platforms equipped with wheels or tracks.

Figure 2:
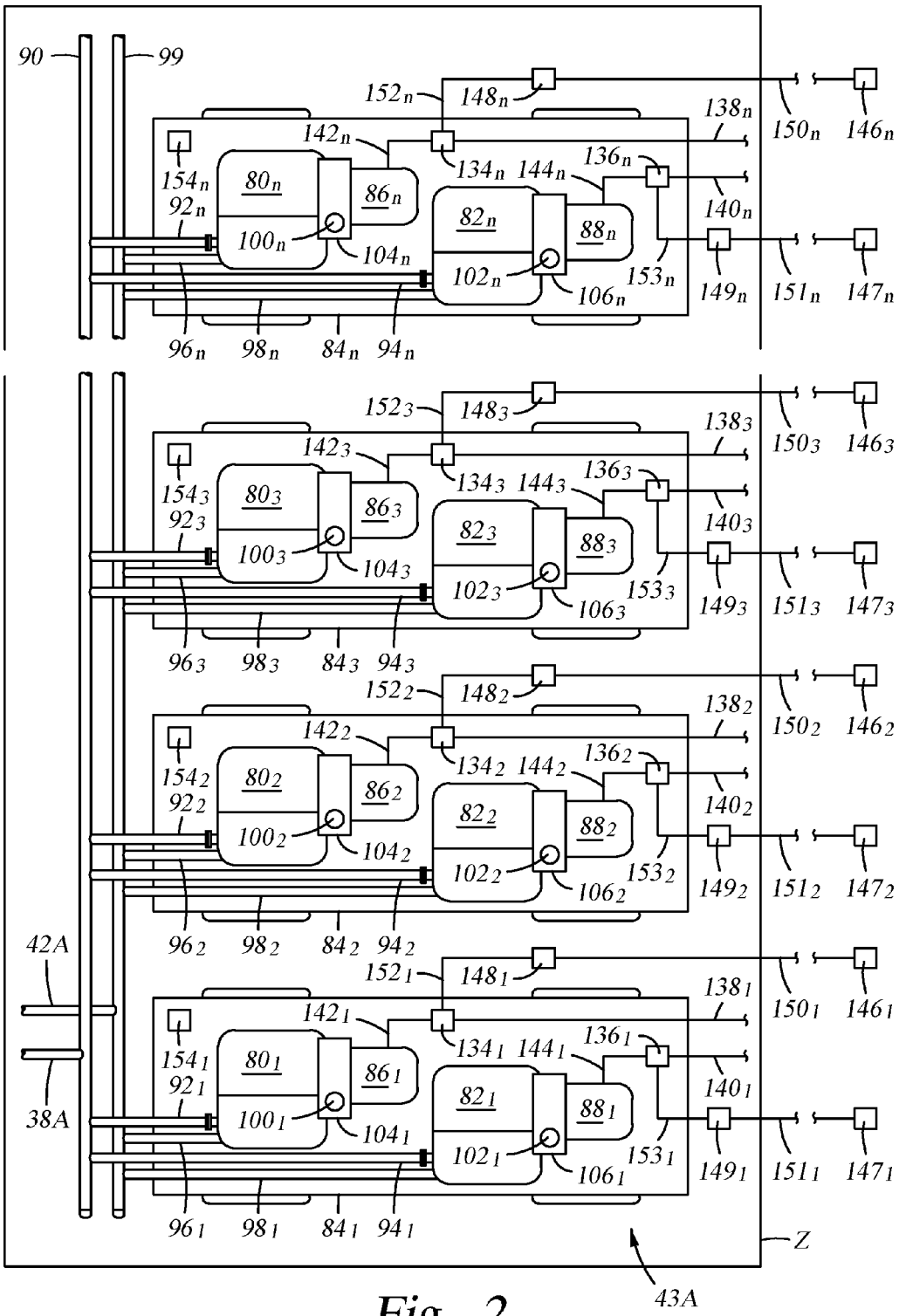
FIG. 2 is a plan schematic view of an example of a fracturing pump system having signal assemblies.

Referring now to FIG. 2 shown in a plan view is an alternate embodiment of a fracturing pump system 43 where a plurality of pumps $\mathbf{80}_{1\text{-}n}$, $\mathbf{82}_{1\text{-}n}$ are shown mounted on a number of trailers $\mathbf{84}_{1\text{-}n}$. Also included in the fracturing pump system 43A are motors $\mathbf{86}_{1\text{-}n}$, $\mathbf{88}_{1\text{-}n}$ which are mounted onto trailers $\mathbf{84}_{1\text{-}n}$, and adjacent to each of the pumps $\mathbf{80}_{1\text{-}n}$, $\mathbf{82}_{1\text{-}n}$. A suction header 90 is shown connected to a line 38A and which provides fracturing fluid to a suction side of each of the pumps $\mathbf{80}_{1\text{-}n}$, $\mathbf{82}_{1\text{-}n}$ via suction leads $\mathbf{92}_{1\text{-}n}$, $\mathbf{94}_{1\text{-}n}$. Similarly, fluid exits the pumps $\mathbf{80}_{1\text{-}n}$, $\mathbf{82}_{1\text{-}n}$ via discharge leads $\mathbf{96}_{1\text{-}n}$, $\mathbf{98}_{1\text{-}n}$ that connect to the discharge side of each of the pumps $\mathbf{80}_{1\text{-}n}$, $\mathbf{82}_{1\text{-}n}$. Discharge leads $\mathbf{96}_{1\text{-}n}$, $\mathbf{98}_{1\text{-}n}$ each connect to a discharge header 99, which routes the pressurized discharge fluid from the leads $\mathbf{96}_{1\text{-}n}$, $\mathbf{98}_{1\text{-}n}$ to discharge piping 42A, where the pressurized fracturing fluid can be transported to wellbore 12 of FIG. 1. Signal assemblies $\mathbf{100}_{1\text{-}n}$, $\mathbf{102}_{1\text{-}n}$ are shown provided on the trailers $\mathbf{84}_{1\text{-}n}$ and which selectively emit visual signals that are indicative of an operational state of the fracturing pump system 43A. Examples of operational states include one where the trailers $\mathbf{84}_{1\text{-}n}$, having the signal assemblies $\mathbf{100}_{1\text{-}n}$, $\mathbf{102}_{1\text{-}n}$ have no electricity provided to them and thus are unpowered and are safe for maintenance. Another example of an operational state is when fluid in the discharge piping, such as the discharge leads $\mathbf{96}_{1\text{-}n}$, $\mathbf{98}_{1\text{-}n}$ exceeds a designated value, for example, when discharge piping is at 100 pounds per square inch or greater. In the example of FIG. 2, the signal assemblies $\mathbf{100}_{1\text{-}n}$, $\mathbf{102}_{1\text{-}n}$ are shown mounted on radiators $\mathbf{104}_{1\text{-}n}$, $\mathbf{106}_{1\text{-}n}$ that are provided on the motors $\mathbf{86}_{1\text{-}n}$, $\mathbf{88}_{1\text{-}n}$. However, signal assemblies $\mathbf{100}_{1\text{-}n}$, $\mathbf{102}_{1\text{-}n}$ can be disposed at any location on trailers $\mathbf{84}_{1\text{-}n}$, or adjacent trailers $\mathbf{84}_{1\text{-}n}$ so that operations personnel can readily view visible signals emitted by these signal assemblies $\mathbf{100}_{1\text{-}n}$, $\mathbf{102}_{1\text{-}n}$.

Figure 3:
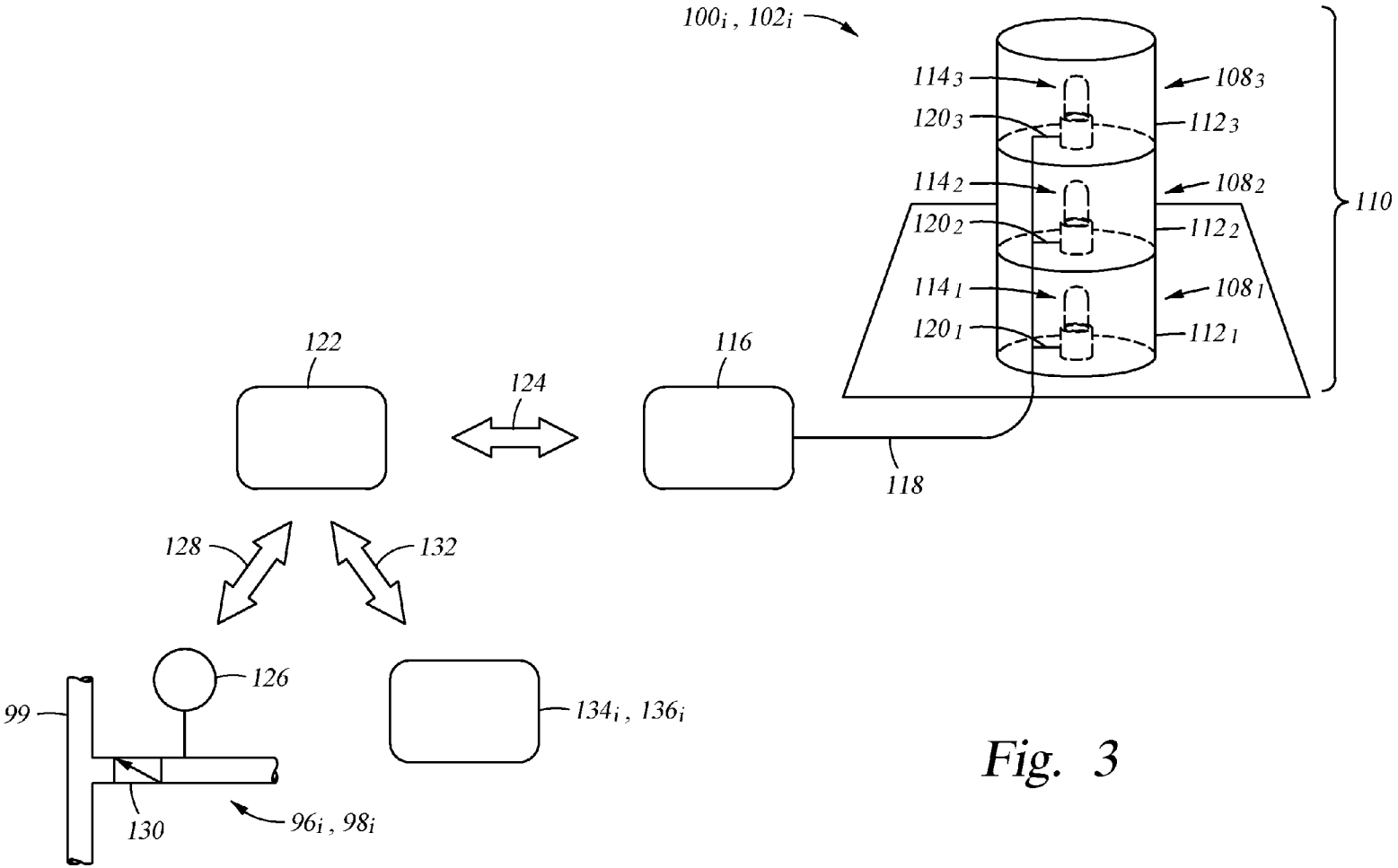
FIG. 3 is a perspective view of an example of a signal assembly and which is in communication with a controller.

Referring now to FIG. 3, illustrated is a schematic example of how the signal assemblies $\mathbf{100}_{1\text{-}n}$, $\mathbf{102}_{1\text{-}n}$ of FIG. 2 are selectively illuminated. Here, example signal assemblies $\mathbf{100}_i$, $\mathbf{102}_i$ are illustrated in perspective view and which are made up of individual light assemblies $\mathbf{108}_{1\text{-}3}$ that are set on one another to form a stack 110. In this example, each light assembly $\mathbf{108}_{1\text{-}3}$ includes a lens $\mathbf{112}_{1\text{-}3}$ which is a layer of translucent or transparent material that has a curved outer surface and circumscribes a light source $\mathbf{114}_{1\text{-}3}$ within the light assembly $\mathbf{108}_{1\text{-}3}$. Either the lens $\mathbf{112}_{1\text{-}3}$ or light source $\mathbf{114}_{1\text{-}3}$ can be formed of a different color from the other lenses $\mathbf{112}_{1\text{-}3}$ or light sources $\mathbf{114}_{1\text{-}3}$, so that if one of the light sources $\mathbf{114}_{1\text{-}3}$ is illuminated, light is projected from that illuminated light sources $\mathbf{114}_{1\text{-}3}$ that has a color that is different from a color of a light emitted by any of the other light assemblies $\mathbf{108}_{1\text{-}3}$. Example colors include green, orange, and red. Electricity for illuminating the light sources $\mathbf{114}_{1\text{-}3}$ can be provided from a power source 116 which connects to the signal light sources $\mathbf{114}_{1\text{-}3}$ via an electrically conducting line 118. Individual leads $\mathbf{120}_{1\text{-}3}$ are shown that connect line 118 to light sources $\mathbf{114}_{1\text{-}3}$, and which provide selective power to the light sources $\mathbf{114}_{1\text{-}3}$. In this way any combination of the light sources $\mathbf{114}_{1\text{-}3}$ can be illuminated at one time. A controller 122 is schematically illustrated and which communicates with power source 116 via a communication means 124. Thus, control signals from controller 122 directed to power source 116 control the selective illumination of the individual light sources $\mathbf{114}_{1\text{-}3}$. Controller 122 is also in communication with a pressure indicator 126 which is shown on discharge leads $\mathbf{96}_i$, $\mathbf{98}_i$. Optionally, a pressure indicator 126 can be provided on discharge outlets of each of pumps $\mathbf{80}_{1\text{-}n}$, $\mathbf{82}_{1\text{-}n}$ (FIG. 2). In FIG. 3, subscript "i" represents any of numbers 1 through n of FIG. 2. Values of pressure measured by pressure indicator 126 within discharge leads $\mathbf{96}_i$, $\mathbf{98}_i$ are transmitted to controller 122 via communication means 128. A check valve 130 is shown in the discharge leads $\mathbf{96}_i$, $\mathbf{98}_i$ and upstream of where the leads $\mathbf{96}_i$, $\mathbf{98}_i$ intersect with discharge header 99, and which allows flow from leads $\mathbf{96}_i$, $\mathbf{98}_i$ to header 99, but is to block flow from header 99 to leads $\mathbf{96}_i$, $\mathbf{98}_i$. Further, communication means 132 provides communication between controller 122 and variable frequency drives ("VFD") $\mathbf{134}_i$, $\mathbf{136}_i$. Each of the communication means 124, 128, 132 can be hard-wired, such as conductive elements or optical cables. Communication means 124, 128, 132 can be wireless as well. Variable frequency drives $134_i$, $136_i$, in one example, operate substantially similar to variable frequency drive 72 of FIG. 1.

Referring back to FIG. 2, variable frequency drives $134_{1-n}$, $136_{1-n}$ are shown provided with each trailer $84_{1-n}$, and that are in electrical communication with electrical power downstream of transformer 56 via lines $138_{1-n}$, $140_{1-n}$. Electrical power from the VFDs $134_{1-n}$, $136_{1-n}$, is selectively provided to motors $86_{1-n}$, $88_{1-n}$ through lines $142_{1-n}$, $144_{1-n}$. The VFDs $134_{1-n}$, $136_{1-n}$ provide control to the motors and can regulate wave forms of the electrical current in order to operate the motors $86_{1-n}$, $88_{1-n}$ at designated values of RPM, torque, or other operational parameters. Pump controllers $146_{1-n}$, $147_{1-n}$ are shown that provide selective input to junction box controllers $148_{1-n}$, $149_{1-n}$ via signal lines $150_{1-n}$, $151_{1-n}$. In the illustrated example junction box controllers $148_{1-n}$, $149_{1-n}$ provide controlling functionality for many of the devices on trailers $84_{1-n}$. In an example, each of junction box controllers $148_{1-n}$, $149_{1-n}$ is equipped with a controller 122 (FIG. 3) for controlling operation of signal assemblies $100_{1-n}$, $102_{1-n}$. Further illustrated is that junction box controllers $148_{1-n}$, $149_{1-n}$ are in controlling communication with the VFDs $134_{1-n1}$, $136_{1-n}$ via signal lines $152_{1-n}$, $153_{1-n}$. As shown, the pump controllers $146_{1-n}$, $147_{1-n}$ are remote from the fracturing pump system 43A and in one example are manipulated by operations personnel in order to operate the pumps $80_{1-n}$, $82_{1-n}$ at designated operational conditions. Examples exist where pump controllers $146_{1-n}$, $147_{1-n}$ are separate consoles for each pump $80_{1-n}$, $82_{1-n}$, or are combined into a single unit. Further schematically illustrated in FIG. 2 are motor control center devices $154_{1-n}$ which represent devices that provide power to auxiliary devices provided with the trailers $84_{1-n}$.

Figure 4A:
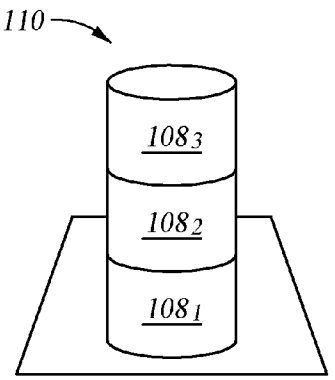
FIGS. 4A-4H are perspective views of examples of the signal assembly of FIG. 3 in different signal configurations.
Figure 4B:
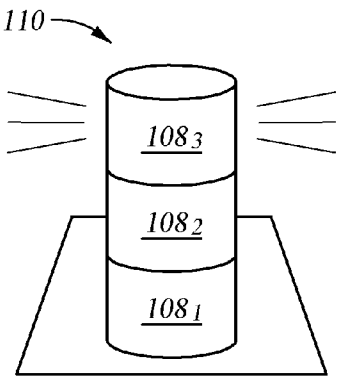
Figure 4C:
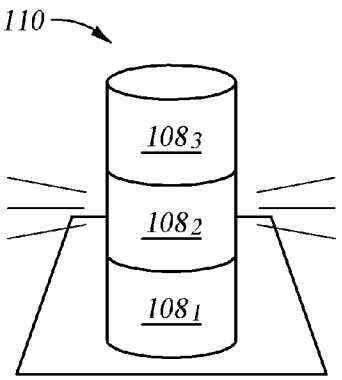
Figure 4D:
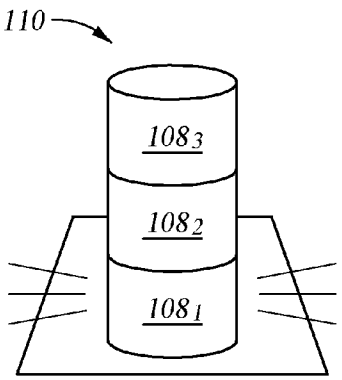
Figure 4E:
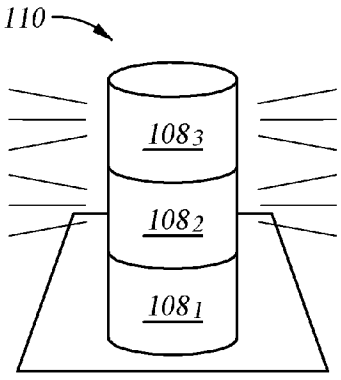

FIGS. 4A through 4H illustrate various combinations of how the light assemblies $108_{1-3}$ might be illuminated to visually convey an indication of an operational state of the fracturing pump system 43A. As shown in FIG. 4A, none of the light assemblies $108_{1-3}$ are illuminated which in this examples indicates that no electrical power is being delivered to the particular VFD $134_{1-n}$, $136_{1-n}$, (FIG. 2) associated with the stack 110. For example, referring back to FIG. 2, it should be pointed out that a signal assembly is associated with a particular VFD that distributes electricity to the motor $86_{1-n}$, $88_{1-n}$ adjacent where the signal assembly $100_{1-n}$, $102_{1-n}$ is located; thus in the example of FIG. 2, signal assembly $100_1$ is associated with VFD $134_1$, signal assembly $102_1$ is associated with VFD $136_1$, and so on. Referring now to FIG. 4B, light assembly $108_3$ is shown to be illuminated whereas light assemblies $108_1$, $108_2$ are not. In an example, selectively illuminating light assembly $108_3$, while not illuminating the other light assemblies $108_{1,\ 2}$, indicates that the fluid in discharge leads $96_{1-n}$, $98_{1-n}$ is at or greater than a designated pressure. In this example, that designated pressure is at least 100 psi, which can indicate either that the plungers (not shown) within the particular pump $80_{1-n}$, $82_{1-n}$ are not stroking and that the particular check valve 130 adjacent the pressure indicator 126 (FIG. 3) has failed. A failed check valve 130 can allow pressure from the discharge header 99, which could be pressurized from a different pump, to enter into the discharge lead $96_{1-n}$, $98_{1-n}$ thereby pressurizing the lead $96_{1-n}$, $98_{1-n}$. This light condition can also indicate that either light assembly $108_1$ or light assembly $108_2$ has failed. This is because illumination of light assembly $108_1$ indicates there is electrical power to the particular trailer $84_{1-n}$ on which the light assemblies $108_1$, $108_2$ are located and that electricity is not flowing from the VFDs $134_{1-n}$, $136_{1-n}$ to the motors $86_{1-n}$, $88_{1-n}$. Light assembly $108_2$ being illuminated indicates there is electrical power being supplied to the trailer $84_{1-n}$ on which the light assemblies $108_1$, $108_2$ are located, and that electricity may be flowing from the VFDs $134_{1-n}$, $136_{1-n}$ to the motors $86_{1-n}$, $88_{1-n}$. Light assembly $108_3$ cannot be illuminated if there is no power to the trailer $84_{1-n}$. FIG. 4C shows where only light assembly $108_2$ is illuminated. This example can represent when the pump controls $146_{1-n}$, $147_{1-n}$ of FIG. 2 are engaged, but a command signal has not yet been delivered to the VFDs $134_{1-n}$, $136_{1-n}$ which would then allow electricity from lines $138_{1-n}$, $140_{1-n}$ to the respective motors $86_{1-n}$, $88_{1-n}$. In FIG. 4D, only light assembly $108_1$ is illuminated. An optional operational state indicated by this visual signal is that the trailer is energized, and that devices other than the motors $86_{1-n}$, $88_{1-n}$ and VFDs $134_{1-n}$, $136_{1-n}$ are powered, such as the auxiliary devices $154_{1-n}$, but not the motors $86_{1-n}$, $88_{1-n}$. In FIG. 4E, light assemblies $108_2$, $108_3$ are illuminated but no light assembly $108_1$. In one embodiment, this visual signal can indicate that the pump unit is pumping under the control of the pump operator and pump controls $146_{1-n}$, $147_{1-n}$. Thus, in this example, the pressure in the discharge leads $96_1$, $98_1$ and discharge header 99, as well as discharge line 42A, are at a pressure that in some instances can fracture the discharge iron.

Figure 4F:
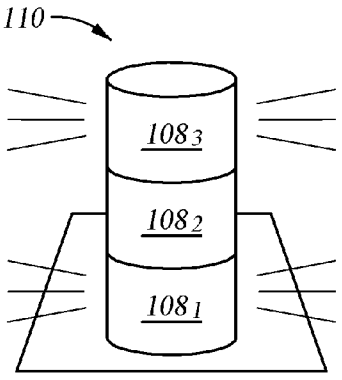
Figure 4G:
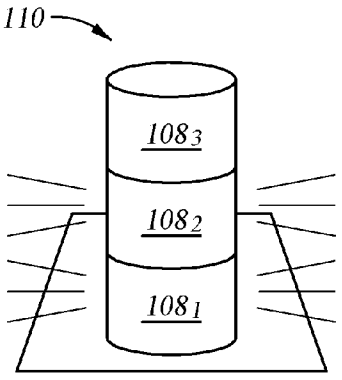
Figure 4H:
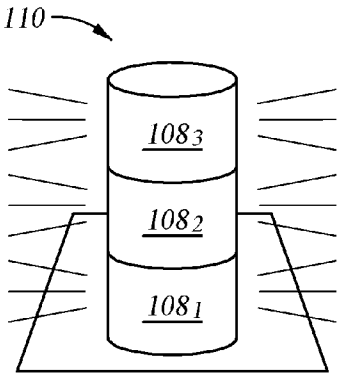

When the lines or iron is subject to fracture this presents a hazardous situation that operations personnel should avoid being in the area. In one example, the area of hazard is designated by the zone Z of FIG. 2; and which also includes the wellhead assembly 41 of FIG. 1. Thus, operations personnel from a distance can view the visual signal emitted by the signal assemblies $100_{1-n}$, $102_{1-n}$ and avoid the area, so that in the event of a failure of a line in the discharge circuit, operations personnel are not subject to a hazardous condition and can avoid personal injury. Shown in FIG. 4F is where light assemblies $108_1$, $108_3$ are illuminated and light assembly $108_2$ is not illuminated. In this example, a check valve failure can be indicated. This condition can also indicate that the pump drive is disabled, but pump pressure from a prior operation has not yet been relieved. In FIG. 4G, light assemblies $108_1$, $108_2$ are depicted as being illuminated, whereas light assembly $108_3$ is not illuminated. Based upon the logic in the previous examples, this is an operational state that is not attainable. Thus, could be an indication that the signal assembly $100_{1-n}$, $102_{1-n}$ is malfunctioning. Similarly, in FIG. 4H, each of the light assemblies $108_{1-3}$ is shown as being illuminated. This is another example where these particular light assemblies should not be illuminated at the same time, possibly indicating a failure of the signal assemblies $100_{1-n}$, $102_{1-n}$ themselves.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, light assemblies $108_{1-3}$ can be spaced apart from one another, and in an arrangement different from a stack 110, such as horizontal or diagonal. Further, the number of light assemblies $108_{1-3}$ less than or greater than three. These and other similar modifications will readily suggest themselves to those skilled in the art, and are intended to be encompassed within the spirit of the present invention disclosed herein and the scope of the appended claims.

What is claimed is:

1. A hydraulic fracturing system for fracturing a subterranean formation comprising:

a plurality of electric pumps fluidly connected to the formation, and powered by at least one electric motor, and configured to pump fluid at high pressure into a wellbore that intersects the formation, so that the fluid passes from the wellbore into the formation, and fractures the formation;

a variable frequency drive connected to the electric motor to control the speed of the motor, wherein the variable frequency drive frequently performs electric motor diagnostics to prevent damage to the at least one electric motor; and a signal assembly that selectively emits a visual signal that is indicative of an operational state of the hydraulic fracturing system.

2. The hydraulic fracturing system of claim 1, wherein the signal assembly comprises a plurality of light assemblies arranged in a stack.

3. The hydraulic fracturing system of claim 2, wherein each of the light assemblies selectively emit visual light of a color different from visual light emitted by other light assemblies.

4. The hydraulic fracturing system of claim 2, wherein a distinctive operational state of the system is indicated by illumination of a combination of the light assemblies.

5. The hydraulic fracturing system of claim 1, wherein the operational states of the hydraulic fracturing system comprise, no electricity to the system, a supply of electricity to all electrically powered devices in the system, a supply of electricity to some of the electrically powered devices in the system, and a pressure in a discharge line of the pump having a magnitude that is at least that of a designated pressure.

6. The hydraulic fracturing system of claim 1, further comprising a controller in communication with the variable frequency drive, a pressure indicator that senses pressure in a discharge line of a one of the pumps, and the signal assembly.

7. The hydraulic fracturing system of claim 6, wherein the controller selectively activates the signal assembly in response to a communication signal from one of the variable frequency drive or the pressure indicator.

8. The hydraulic fracturing system of claim 1, wherein the visual signal comprises light in the visible spectrum, and that is optically detectable by operations personnel disposed in a zone that is potentially hazardous due to fluid in piping that is pressurized by at least one of the pumps.

9. A hydraulic fracturing system for fracturing a subterranean formation comprising:

a pump having a discharge in communication with a wellbore that intersects the formation;

an electric motor coupled to and that drives the pump;

a variable frequency drive connected to the electric motor that controls a speed of the motor and performs electric motor diagnostics;

a signal assembly that selectively emits different visual signals that are distinctive of an operational state of the system; and a controller in communication with the signal assembly, and that selectively transmits a command signal to the signal assembly in response to a monitoring signal received by the controller and transmitted from a device in the system.

10. The hydraulic fracturing system of claim 9, wherein the device in the system that transmits the monitoring signal to the controller comprises one of the variable frequency drive, and a pressure monitor in fluid communication with the discharge of the pump.

11. The hydraulic fracturing system of claim 9, wherein the signal assembly comprises a stack of light assemblies.

12. The hydraulic fracturing system of claim 11, wherein the light assemblies each comprise an electrically powered light source, and that each emit light of a color that is different from a color of a light emitted by the other light assemblies.

13. The hydraulic fracturing system of claim 9 further comprising a pump controller and auxiliary equipment, and wherein the operational state of the system comprises, the system being isolated from electricity, a fluid pressure of the discharge having a value at least as great as a designated value, the pump drive being energized, and the auxiliary equipment being energized but without a one of the motors being energized.

14. The hydraulic fracturing system of claim 9, wherein the visual signals selectively indicate when the system is safe for operations personnel, when the system is potentially unsafe for operations personnel, and when the system is currently unsafe for operations personnel.

15. A method of fracturing a subterranean formation comprising:

pressurizing fracturing fluid with a pump;

driving the pump with a motor that is powered by electricity;

controlling the speed of the motor with a variable frequency drive, the variable frequency drive further performing electric motor diagnostics;

monitoring an operational state of a hydraulic fracturing system that comprises the pump and motor; and selectively emitting a visual signal that is indicative of the monitored operational state.

16. The method of claim 15, wherein the operational state comprises the system being isolated from electricity, a fluid pressure of discharge of the pump having a value at least as great as a designated value, a pump controller being energized, and auxiliary equipment being energized but without a one of the pump motors being energized.

17. The method of claim 15, wherein the step of selectively emitting a visual signal comprises emitting a light from one or more of a stack of light assemblies, where light from one of the stack of light assemblies is different from lights emitted from other light assemblies.

18. The method of claim 15, further comprising monitoring electricity to a variable frequency drive, wherein the variable frequency drive controls electricity to the motor.

19. The method of claim 15, further comprising monitoring a fluid pressure of discharge of the pump.

* * * * *